US007003813B1

(12) United States Patent
Krause

(10) Patent No.: US 7,003,813 B1
(45) Date of Patent: Feb. 28, 2006

(54) TWO-WAY VALVE FOR DISPENSING LIQUIDS

(76) Inventor: Clifford G. Krause, 3214 Potomac Dr., Garland, TX (US) 75042

( * ) Notice: Subject to any disclaimer, the term of this patent is extended or adjusted under 35 U.S.C. 154(b) by 0 days.

(21) Appl. No.: 10/926,166

(22) Filed: Aug. 26, 2004

(51) Int. Cl.
*E03D 9/02* (2006.01)

(52) U.S. Cl. ..... 4/227.3; 4/227.2

(58) Field of Classification Search ..... 4/222, 4/227.2–227.4; 222/56, 57, 67
See application file for complete search history.

(56) References Cited

U.S. PATENT DOCUMENTS 3,841,524 A * 10/1974 Easter ..... 222/57
3,908,209 A * 9/1975 Fillmore ..... 4/227.3
4,285,074 A * 8/1981 Leinberry ..... 4/227.3
4,696,414 A * 9/1987 Huat ..... 222/67
6,496,987 B1 * 12/2002 Chou ..... 4/227.2

* cited by examiner

*Primary Examiner*—Justine R. Yu
*Assistant Examiner*—Huyen Le
(74) *Attorney, Agent, or Firm*—Gary C. Honeycutt

(57) ABSTRACT

A two-way flow control valve for repeatedly dispensing a limited amount of liquid. A float valve is linked to a second valve and storage chamber such that one valve is closed when the other is opened, and vice versa. The chamber fills when the float valve is closed, and empties when the float valve is opened. The assembly is useful for dispensing a liquid cleaner into a toilet tank.

5 Claims, 2 Drawing Sheets

TWO-WAY VALVE FOR DISPENSING LIQUIDS

FIELD OF THE INVENTION

This invention relates to flow control apparatus including a valve assembly for dispensing a liquid; and more particularly to a valve for the intermittent release of a controlled amount of liquid from an inverted container, to be used for example in a toilet tank.

BACKGROUND OF THE INVENTION

Many products have been developed and marketed for the intermittent release of a cleaning agent, disinfectant, or deodorant into a flush-type toilet tank. Typically, an inverted bottle of liquid is suspended inside the tank, so that the neck of the bottle is immersed in water. A float valve inside the neck of the bottle is held in a closed position by the water, until the toilet is flushed, causing the water level to drop, and thereby causing the valve to open. The liquid then flows from the bottle, until the tank is again full of water. The amount of liquid released from the bottle after each flush depends of course upon the time required for the tank to re-fill.

Such products are intended to last for perhaps a hundred or more flushes. But a single malfunction of the flush mechanism may cause the tank to remain empty long enough for all the liquid to escape from the bottle, before the problem is discovered. Thus it would be desirable to provide some means for limiting the amount of liquid that can escape after each flush.

SUMMARY OF THE INVENTION

This invention solves the problem by providing a two-way valve comprising a float valve in combination with a second valve and chamber, for limiting the amount of liquid that is released, and for preventing the flow of excess liquid from the bottle. Thus the amount of liquid released does not depend upon the time required for the tank to re-fill.

The second valve opens as the float valve closes, in order to transfer a small amount of liquid from the bottle into the chamber. That amount of liquid is stored in the chamber until the toilet is flushed, causing the float valve to open, which releases the stored liquid from the chamber into the toilet tank. At the same time, the second valve closes, to prevent the release of any additional liquid from the bottle.

DETAILED DESCRIPTION OF THE PREFERRED EMBODIMENTS

Figure 1C:
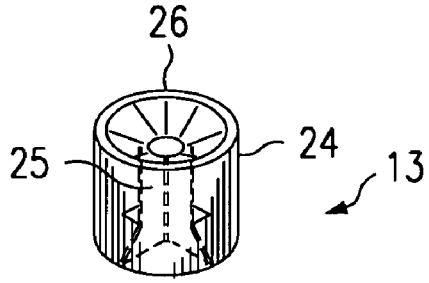
FIG. 1*c* is a perspective view of the upper section of the preferred embodiment.
Figure 1A:
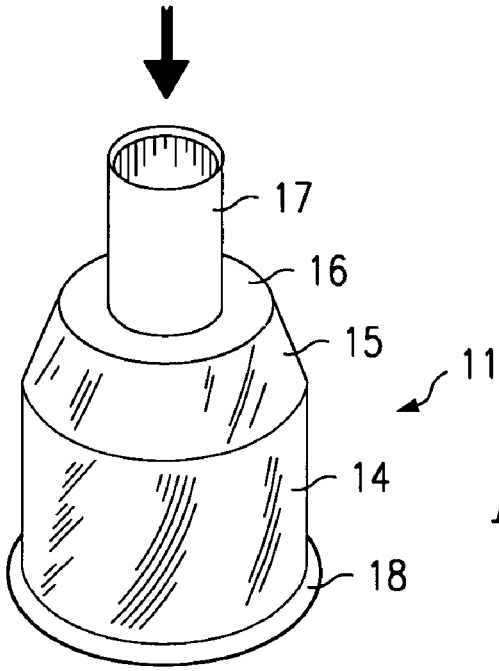
FIG. 1*a* is a perspective view of the middle section of a preferred embodiment of the invention.

In FIG. 1*a* middle section 11 is seen to include a tubular member 14 adapted to fit into the neck of a bottle or other container from which a liquid is to be dispensed. Beveled surface 15 supports a shoulder area 16 which is connected to a tubular extension 17. A lip 18 acts to prevent the assembly from slipping too far into the bottle.

Figure 1B:
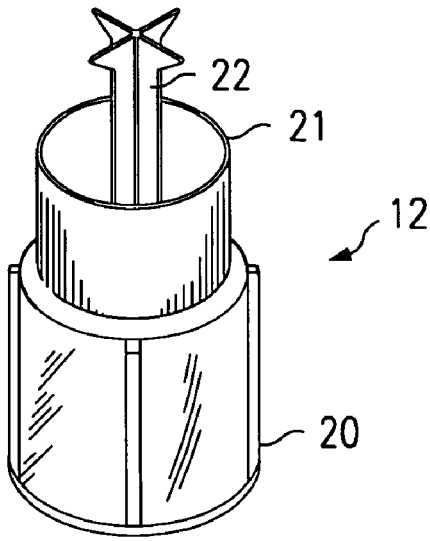
FIG. 1*b* is a perspective view of the lower section of the preferred embodiment.

In FIG. 1*b* lower section 12 is seen to include a tubular float member 20 which is lifted by the water level in the tank, so that the float valve closes when rim 21 is pushed into sealing contact with the under side of shoulder 16. In an alternate embodiment, float valve closure is provided by contact of the lower end of wall 19 on a beveled wall inside the lower section. If desired, both float valve closure seats can be provided in the same embodiment. At the same time, push rod 22 moves rod 25 and thereby lifts section 13, to open the second valve.

In FIG. 1*c* the upper section is seen to include a tubular member 24 having a closed and beveled top 26, and an open lower rim 27. Rod 25 is attached to top surface 26. When float 20 is released by flushing the toilet, section 13 drops until the beveled lower surface of top 26 comes to rest on the upper rim of extension 17, thereby closing the second valve to prevent the escape of excess liquid from the bottle. In an alternate embodiment, closure of the second valve is obtained when the lower rim of section 13 contacts shoulder 16 of the middle section. Both closure mechanisms are possible in the same embodiment.

Figure 2:
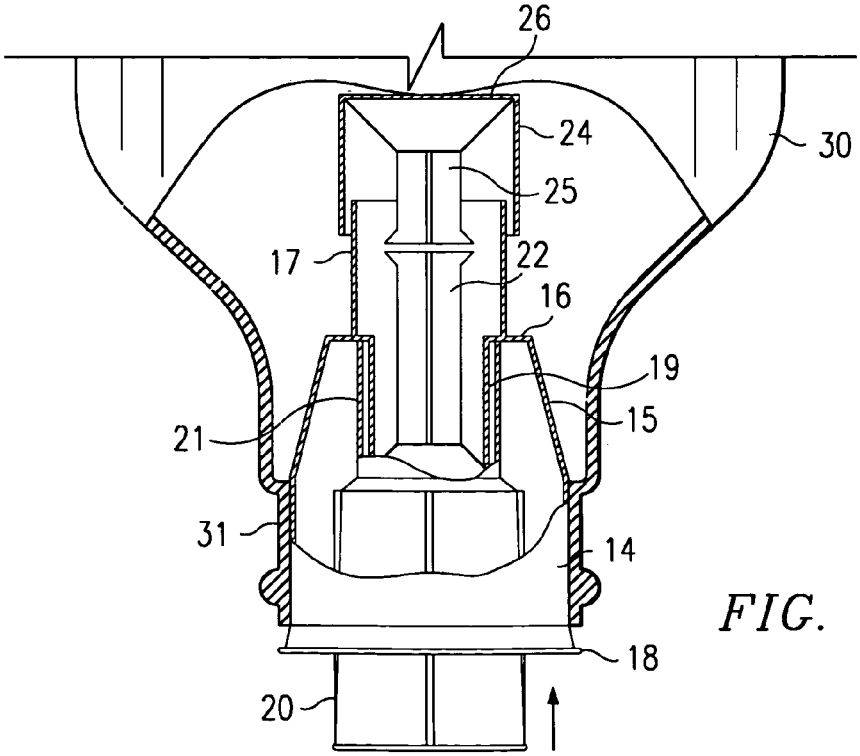
FIG. 2 is a cut-away cross-section of the preferred embodiment, fully assembled and inserted into the neck of a bottle, showing the closed position of the float valve.

In FIG. 2 the three sections are shown fully assembled inside neck 31 of bottle 30, with the float valve closed and the second valve open. In this position, liquid from the bottle flows through the annulus between tubular walls 17 and 24, thereby filling the chamber formed by tubular walls 17 and 19 of the middle section.

Figure 3:
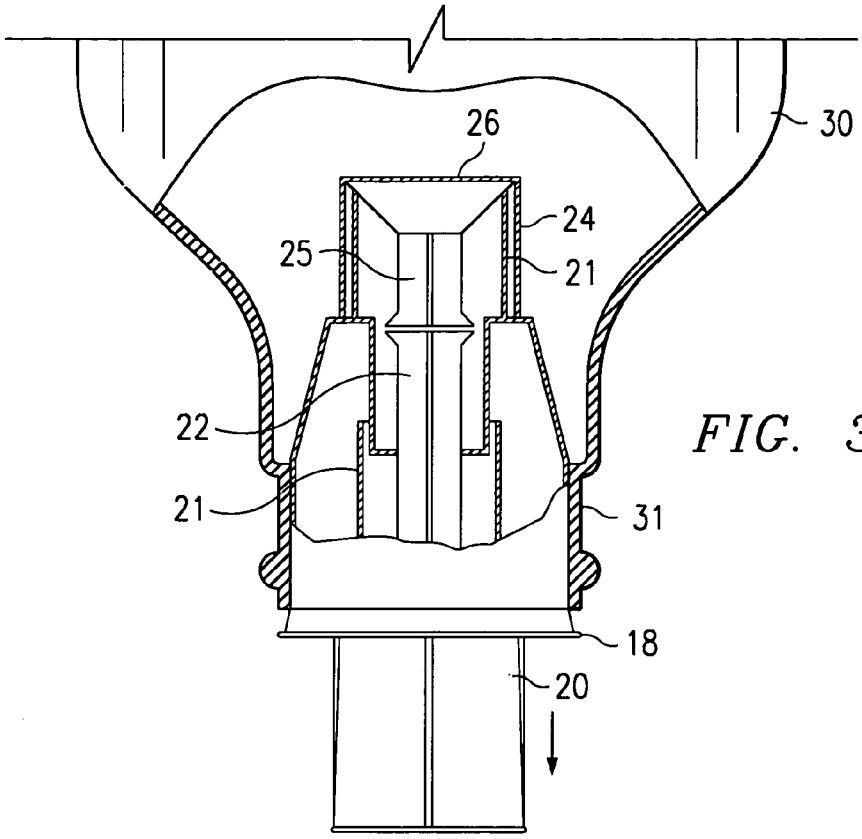
FIG. 3 is a cut-away cross-section of the fully assembled embodiment, showing the open position of the float valve.

In FIG. 3 the float valve is open and the second valve is closed. In this position, a portion of the liquid stored in the chamber flows into the toilet tank. No additional liquid from the bottle can escape because the second valve is closed. Thus, if the tank does not re-fill, the second valve remains closed, to prevent the loss of any additional liquid from the bottle.

All the illustrated parts are readily made from ordinary plastic. For example, sections 1*a*, 1*b* and 1*c* are molded separately and then assembled for insertion into the neck of a bottle. The upper and lower sections are molded to include "snap on" assembly with the middle section, by providing a flared tip on each push rod, and narrowed openings in the middle section, so that the width of each tip slightly exceeds the diameter of the openings. Thus, a force is required to insert the push rods through the openings. Once inserted, the rods move freely inside the middle section.

An alternate snap on mechanism includes the molding of a ring or lip at the lower end of wall 24, and a similar ring or lip at the upper end of wall 21. Matching rings are provided on the middle section parts, so that insertion of the upper and lower sections into the middle section requires some force to push or "snap" the parts together.

What is claimed is:

1. Flow control apparatus comprising:

a float section including a float valve adapted for location in the outlet of a liquid-filled container; said float valve comprising a tubular float member surrounding a first tubular guide member, said guide member including an outwardly extending flange, one surface of which serves as a valve seat for said float member;

a center section including a second valve in combination with said float valve;

means in combination with said float valve for causing the second valve to open when the float valve is closed, and for causing the second valve to close when the float valve is open; and a chamber in combination with said valves, for receiving and storing a portion of said liquid when said second valve is opened, such that only said stored portion is released when said float valve is opened.

2. Flow control apparatus as in claim 1 wherein said float section includes a beveled inner wall that serves to close the valve when it contacts the lower end of a tubular wall inside the center section.

3. Flow control apparatus as in claim 1 wherein said second valve comprises a second tubular guide member, connected to the opposite surface of said flange, surrounded by a tubular cap which rests on the opposite surface of said flange when closed, and which is operable to open when lifted by said float valve.

4. Flow control apparatus as in claim 3 wherein the tubular cap of said second valve includes a beveled surface that comes to rest on top of said second tubular guide member, for closure of said second valve.

5. Flow control apparatus comprising:

a float section including a float valve adapted for location in the outlet of a liquid-filled container;

a center section including a second valve and a tubular wall in combination with said float valve;

means in combination with said float valve for causing the second valve to open when the float valve is closed, and for causing the second valve to close when the float valve is open;

said float section including a beveled inner wall that serves to close the float valve when it contacts the lower end of said tubular wall in the center section; and a chamber in combination with said valves, for receiving and storing a portion of said liquid when said second valve is opened, such that only said stored portion is released when said float valve is opened.

* * * * *